US007336025B2

(12) United States Patent
Hu et al.

(10) Patent No.: US 7,336,025 B2
(45) Date of Patent: Feb. 26, 2008

(54) ARRAY OF BARRIERS FOR FLAT PANEL DISPLAYS AND METHOD FOR MAKING THE ARRAY OF BARRIERS

(75) Inventors: Zhaofu Hu, Beijing (CN); Pijin Chen, Beijing (CN); Liang Liu, Beijing (CN); Shou Shan Fan, Beijing (CN)

(73) Assignees: Tsinghua University, Bejing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 10/810,023

(22) Filed: Mar. 26, 2004

(65) Prior Publication Data

US 2004/0189172 A1 Sep. 30, 2004

(30) Foreign Application Priority Data

Mar. 26, 2003 (CN) ..... 03 1 14071

(51) Int. Cl.
*H01J 1/88* (2006.01)

(52) U.S. Cl. ..... 313/292; 313/238

(58) Field of Classification Search ..... 313/292, 313/495, 238, 582, 610; 445/24, 25
See application file for complete search history.

(56) References Cited

U.S. PATENT DOCUMENTS 3,688,359 A 9/1972 Oikawa et al.
5,534,743 A * 7/1996 Jones et al. ..... 313/309
5,543,683 A * 8/1996 Haven et al. ..... 313/461
5,548,181 A * 8/1996 Jones ..... 313/309
6,107,731 A * 8/2000 Spindt et al. ..... 313/495
6,413,135 B1 7/2002 Kim et al.
6,508,685 B1 1/2003 Lee et al.
6,530,814 B1 3/2003 Browning et al.
6,537,120 B1 3/2003 Yoo

FOREIGN PATENT DOCUMENTS

TW 312800 8/1997

* cited by examiner

*Primary Examiner*—Joseph Williams
(74) *Attorney, Agent, or Firm*—Wei Te Chung

(57) ABSTRACT

A method for making barrier arrays for use in flat panel displays includes the following steps: providing a metal plate; using photolithographic etching of the metal plate to form a shadow mask (21) having a number of openings defined therethrough according to a pixel pattern of a flat panel display; and forming an insulative layer (31) on the shadow mask. The technology for making a shadow mask is mature. In addition, a thickness and a material of the shadow mask can be selected according to the requirements of the flat panel display desired. Furthermore, the thickness and the material of the insulative layer can be determined according to the insulative performance required for the flat panel display. In summary, the present invention provides a barrier array having high precision at a low production costs. The barrier arrays are suitable for mass production in an environmentally friendly manner.

8 Claims, 2 Drawing Sheets

ARRAY OF BARRIERS FOR FLAT PANEL DISPLAYS AND METHOD FOR MAKING THE ARRAY OF BARRIERS

BACKGROUND OF THE INVENTION

1. Field of the Invention

The present invention relates to flat panel displays, such as field emission displays and plasma displays. Specifically, the present invention relates to an improved array of barriers for such flat panel displays and a method for making the same.

2. Description of Prior Art

Flat panel displays, such as a typical plasma display panel or a typical field emission display, are well known as display devices capable of replacing a cathode-ray tube (CRT) since they have a small volume, low power consumption, and are suitable for mass production. An array of barriers is used to support and insulate pixels in such flat panel displays. To achieve superior display features, barrier array should be made have a flat upper surface, and the height of the barrier array should be uniform throughout the entire barrier array. Furthermore, the material of which the barrier array is made should not be porous to prevent air from being trapped in the pores thereof. Thus the method for manufacturing barrier array is critical in making flat panel displays.

The two main methods for making barrier array in the art are the screen printing method and the sandblasting method. In the screen printing method, each barrier array is formed by repeatedly screen printing and drying paste material on a substrate, and then baking the assembly. However, during the repeated printing and drying procedure, it is difficult to ensure that the array has a flat upper surface and uniform height, and this leads to increases in production costs. In addition, it is also difficult to fabricate the barrier array with high precision when using the screen printing method. Thus, screen printing is not suitable for mass production of high quality barrier array.

A sandblasting method is also widely used, in which material for the barrier array is applied to a substrate at a predetermined thickness, and then dried. Then a protective film having the shape of the desired barrier array is formed on the assembly, or a sand blasting mask is attached to the assembly. Sand is injected at high pressure so that unwanted portions of the assembly are removed, thus forming the barrier array. Finally, the barrier array is baked. However, the whole manufacturing process takes a considerable time, and control of the sand injection must be highly accurate. The sandblasting method is not very reliable, and is also prone to contaminate the manufacturing environment with sand.

Other methods for making barrier array for flat panel displays use photolithography, molding, and casting. However, all these methods require mating of a substrate with suitable pastes, as well as drying and baking processes. This makes these methods unduly time-consuming. Furthermore, it is difficult to fabricate barrier arrays with high precision using these methods.

SUMMARY OF THE INVENTION

In view of the above-described drawbacks, an object of the present invention is to provide a barrier array for use in flat panel displays which has a flat upper surface and uniform height.

Another object of the present invention is to provide a barrier array for use in flat panel displays which is low cost and suitable for mass production.

A further object of the present invention is to provide a method for easily making high precision barrier array used in flat panel displays.

A still further object of the present invention is to provide a method for making high precision barrier array used in flat panel displays, the method being environmentally friendly.

In order to achieve the objects set out above, in one aspect of the present invention, a barrier array for use in a flat panel display in accordance with the present invention comprises a shadow mask defining a plurality of openings therethrough according to a predetermined pattern, and an insulative layer formed thereon. The predetermined pattern is in accordance with a pixel pattern of the flat panel display.

In order to achieve the objects set out above, in another aspect of the present invention, a preferred method of the present invention for making the above described barrier array comprises the following steps: providing a metal plate; using the metal plate to form a shadow mask by photolithographic etching, thereby defining a plurality of openings therethrough according to a predetermined pattern, which pattern is in accordance with a pixel pattern of a flat panel display; forming an insulative layer on the shadow mask. Because making a shadow mask is a mature technology in CRT, this method employs the mature technology. In addition, a thickness and a material of the shadow mask can be selected according to the particular requirements of the flat panel display desired. Furthermore, the thickness and the material of the insulative layer can be determined according to the insulative performance required for the flat panel display. Moreover, the barrier array may be produced a large enough size that it can be subdivided for use in a plurality of flat panel displays. In summary, the present invention provides barrier arrays having high precision and low production costs, and the barrier arrays are being suitable for mass production in an environmentally friendly manner.

Other objects, advantages and novel features of the present invention will become more apparent from the following detailed description when taken in conjunction with the accompanying drawings, in which:

DETAILED DESCRIPTION OF PREFERRED EMBODIMENTS OF THE INVENTION

Figure 1:
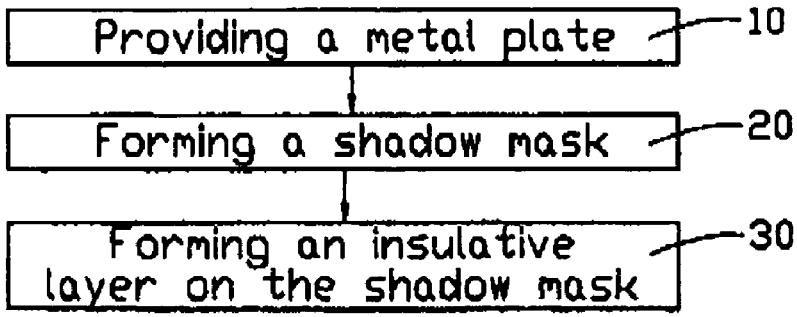
FIG. 1 is a flowchart of the preferred method for making barrier array used in flat panel displays, according to the present invention.

The preferred method for making a barrier array used in flat panel displays according to the present invention will be described with reference to the flowchart of FIG. 1.

A metal plate is first provided (step 10). The metal plate can be made from an iron-nickel alloy (for example, invar™), low carbon steel, or another suitable metal alloy that has a coefficient of thermal expansion matching that of a substrate of a flat panel display.

Figure 2:
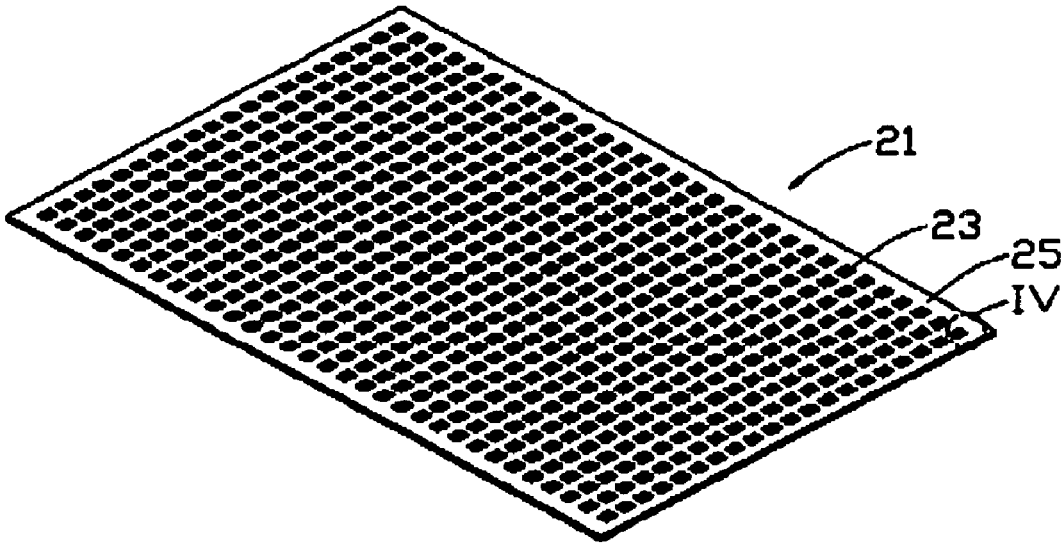
FIG. 2 is a perspective view of a shadow mask formed according to the present invention.

A mask is provided prior to form a shadow mask. The mask has a predetermined pattern according to a pixel pattern of one or more desired flat panel displays. For the purposes of describing the present invention simply, it will be assumed hereafter that a pixel pattern for only one flat panel display is desired. A shadow mask is then formed by photolithographic etching, using the mask (step 20). Referring to FIG. 2, the shadow mask 21 comprises metal plate 25 and a plurality of openings 23 defined therethough. The plurality of openings 23 are of sizes and are arranged in an may according to the pixel pattern of the flat panel display.

An insulative layer is then formed on the shadow mask (step 30). Generally, the insulative layer can be formed by electrophoretic deposition, spray coating or another suitable method. Preferably, the electrophoretic deposition method is employed. The insulative layer can be alumina, magnesia or another insulative material selected to meet a required insulative performance of the flat panel display. In the preferred method, alumina is used as the insulative material.

Figure 3:
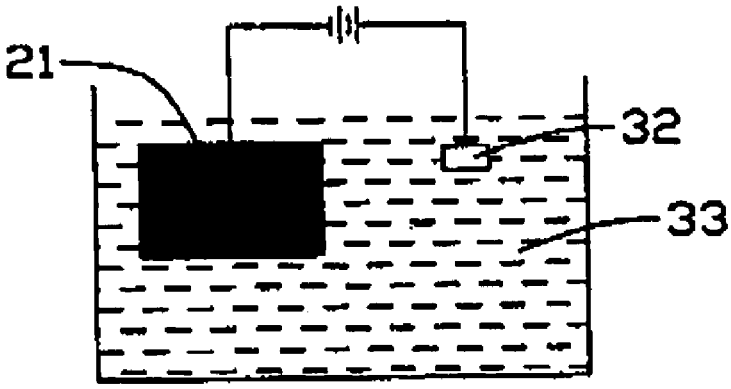
FIG. 3 is a schematic diagram illustrating formation of an insulative layer on the shadow mask of FIG. 2 according to the preferred method.

FIG. 3 is a schematic diagram showing an arrangement for deposition of an insulative layer on the shadow mask 21 according to the preferred method: The shadow mask 21 is used as an anode and metal aluminum 32 is used as a cathode. An electrolyte 33 comprises aluminum ions. In the preferred method, the electrolyte 33 comprises methyl alcohol (600 ml), magnesium sulfate (6 g), aluminum nitrate (30 ml), alumina (900 g) and deionized water (600 ml). The time needed for the electrophoretic deposition is determined by a required thickness of the insulative layer on the shadow mask 21, which in turn is determined according to a required insulative performance of the flat panel display.

Figure 4:
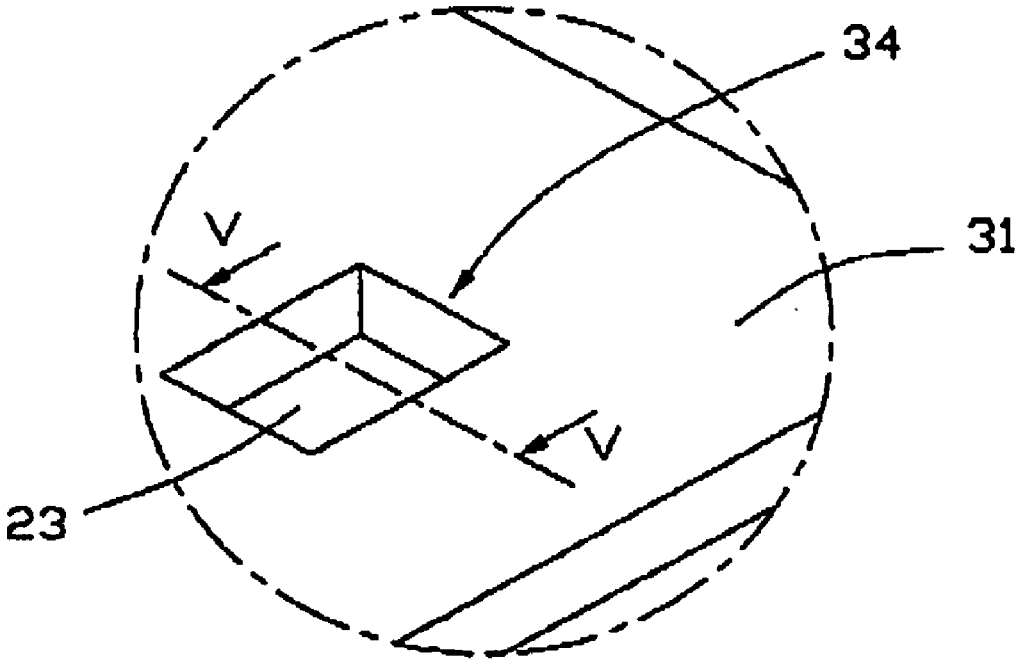
FIG. 4 is an enlarged view corresponding to a circled portion IV of FIG. 2, showing a barrier array portion of a barrier array formed according to the preferred method.
Figure 5:
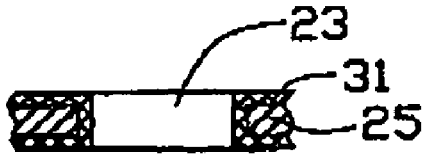
FIG. 5 is a cross-sectional view of the barrier array portion of FIG. 4, taken along line V-V thereof.

Referring also to FIGS. 4 and 5, each of barrier array portions 34 of which the barrier array is comprised is completed once an insulative layer 31 of alumina material has been deposited on the shadow mask 21 to a predetermined thickness. Each barrier array portion 34 comprises a part of the shadow mask 21 and the insulative layer 31 formed thereon. FIG. 5 shows a cross-sectional view of the barrier array portion 34 of FIG. 4 taken along line V-V thereof. The metal plate 25 and a peripheral sidewall of the opening 23 of the barrier array portion 34 are, as shown in FIG. 5, directly coated and/or covered by the insulative layer 31. A thickness of the insulative layer 31 is in the range from 10 to 500 micrometers, and preferably is in the range from 75 to 200 micrometers.

After the insulative layer 31 has been deposited on the shadow mask 21, the barrier array is preferably soaked in a solution for a predetermined time to clean surfaces of the barrier array. In the preferred method, the solution comprises ethyl cellulose (85 g), butyl alcohol (60 ml) and xylene (3400 ml, 3°), and the predetermined time is 1~5 minutes. Then, the barrier array is cured.

Because making a shadow mask is a mature technology used in CRT manufacturing, the above-described method employs mature technology. In addition, a thickness and a material of the metal plate 25 can be selected according to the particular requirements of the flat panel display desired. Furthermore, a thickness and a material of the insulative layer 31 can be determined according to the insulative performance required for the flat panel display. Moreover, the barrier array can be produced in a size large enough for it to be subdivided for use in a plurality of flat panel displays. In summary, the present invention provides barrier arrays having a high precision flat upper surface and a uniform height. The barrier arrays are suitable for inexpensive mass production in an environmentally friendly manner.

It is understood that the invention may be embodied in other forms without departing from the spirit thereof. Thus, the present examples and embodiments are to be considered in all respects as illustrative and not restrictive, and the invention is not to be limited to the details given herein.

We claim:

1. A barrier array for use in a flat panel display, comprising:

a shadow mask including a metal plate and a plurality of openings defined therethrough according to a predetermined pattern, the predetermined pattern being in accordance with a pixel pattern of a flat panel display, the metal plate having an upper surface and a lower surface; and an insulative layer including a first portion directly formed on the upper surface of the metal plate, a plurality of second portions, and a third portion directly formed on the lower surface of the metal plate, the second portions disposed in the respective openings and connecting the first portion with the third portion.

2. The barrier array as described in claim 1, wherein the metal plate is made from a material selected from the group consisting of: an iron-nickel alloy, low carbon steel, and another suitable metal alloy; and the material has a coefficient of thermal expansion matching that of a substrate of the flat panel display.

3. The barrier array as described in claim 1, wherein the insulative layer comprises alumina or magnesia.

4. The barrier array as described in claim 3, wherein a thickness of the insulative layer is in the range from 10 to 500 micrometers.

5. The barrier array as described in claim 3, wherein a thickness of the insulative layer is in the range from 75 to 200 micrometers.

6. A barrier array for use in a flat panel display, consisting essentially of:

a metal plate including a plurality of openings therethrough according to a pixel pattern of a flat panel display, the metal plate having an upper surface and a lower surface opposite to the upper surface; and an insulative layer including a first portion directly formed on the upper surface of the metal plate and a plurality of second portions, the second portions extending from the first portion into the respective openings and directly formed on inner edges of the metal plate that bound the respective openings.

7. The barrier array as described in claim 6, wherein the insulative layer includes a third portion formed on the lower surface of the metal plate.

8. The barrier array as described in claim 6, wherein a thickness of the insulative layer is in the range from 10 to 500 micrometers.

* * * * *